US008203412B2

(12) United States Patent
Zhong et al.

(10) Patent No.: US 8,203,412 B2
(45) Date of Patent: Jun. 19, 2012

(54) DOUBLE ACTIVE PARTS STRUCTURE OF REACTOR

(75) Inventors: Juntao Zhong, Xinjiang (CN); Yumin Ren, Xinjiang (CN); Xingyao Gao, Xinjiang (CN); Chunzhen Gu, Xinjiang (CN); Shubo Sun, Xinjiang (CN)

(73) Assignee: Tebian Electric Apparatus Stock Co., Ltd, Xinjiang (CN)

( * ) Notice: Subject to any disclaimer, the term of this patent is extended or adjusted under 35 U.S.C. 154(b) by 109 days.

(21) Appl. No.: 12/674,396

(22) PCT Filed: Jun. 26, 2008

(86) PCT No.: PCT/CN2008/001229

§ 371 (c)(1),
(2), (4) Date: May 7, 2010

(87) PCT Pub. No.: WO2009/024009

PCT Pub. Date: Feb. 26, 2009

(65) Prior Publication Data

US 2011/0148557 A1 Jun. 23, 2011

(30) Foreign Application Priority Data

Aug. 20, 2007 (CN) ..... 2007 1 0138792

(51) Int. Cl.
*H01F 27/28* (2006.01)

(52) U.S. Cl. ..... 336/182; 336/220; 336/180

(58) Field of Classification Search ..... 336/90–96, 336/220–221, 55–62, 5, 180, 182
See application file for complete search history.

(56) References Cited

U.S. PATENT DOCUMENTS 3,156,624 A * 11/1964 Clifford et al. ..... 376/341
3,703,692 A * 11/1972 Peschel ..... 336/134
4,145,679 A * 3/1979 Mitchell, Jr. ..... 336/57

FOREIGN PATENT DOCUMENTS

CN 1737960 A 2/2006
JP 58130512 A 8/1983
JP 06302442 A 10/1994

* cited by examiner

*Primary Examiner* — Anh Mai
(74) *Attorney, Agent, or Firm* — The Webb Law Firm

(57) ABSTRACT

A double active parts structure of a reactor comprises two separate active parts that are coupled together by its inner coils. The arrangement mode of the two active parts is parallel or in-line.

8 Claims, 5 Drawing Sheets

DOUBLE ACTIVE PARTS STRUCTURE OF REACTOR

TECHNICAL FIELD

The present invention belongs to the technical field of reactors, and relates to a double active parts structure of a reactor.

BACKGROUND

The current single-phase iron core reactor is an assembly of a single "EI" shaped iron core active part and a single coil. This structure is suitable for the reactor whose operation voltage and capacity are below certain values respectively. However, when the voltage level and the capacity of a reactor reach a certain degree (e.g., a reactor in which the voltage level is 800 kV, and the capacity is 100000 kvar), as the reactor becomes larger and larger, the width and height of the reactor further increase, which brings difficulties to transportation of the reactor. In addition, since the creepage distance of the insulating member of the reactor is limited, it is not allowed that the voltage unlimitedly increases in a certain insulating distance. When the voltage level of the reactor further increases, the creepage voltage applied onto the insulating member correspondingly increases, which brings hidden danger to the reactor.

SUMMARY

The problem to be solved in the present invention is to provide a double active parts structure of a reactor, which is assembled relatively simple, has smaller magnetic loss, and operates reliably in comparison with the defects existing in the single active part structure of a reactor in the prior art.

The technical solution to solve the problem in the present invention is that the double active parts structure of a reactor comprises a reactor active part, wherein the reactor active part comprises two separate active parts, which are coupled together by its inner coils.

The arrangement mode of the two active parts can be in parallel. A leading-out wire (connection between the two coils) can be away from the ground potential by using such parallel arrangement, and the diameter of the electrode of the leading-out wire can be decreased. Alternatively, the arrangement mode of the two active parts can be an in-line one. By using such in-line arrangement, there is little interference of the magnetic leakage between the two coils in the two active parts.

Each of the two separate active parts comprises an "EI" shaped iron core, in the middle of which an iron core limb is formed by the lamination of a plurality of iron core cakes with central holes and a plurality of air gaps.

The two active parts of the reactor are placed in a same reactor oil tank. Since the effective voltages of the two active parts under the operation voltage are different from each other, the insulating distances of the two active parts are different from each other. Thus, the two active parts can be a bigger one and a smaller one. When the two active parts are in a serial structure, according to the detailed condition, the voltage capacity of the first active part can be 30-70% of the whole voltage capacity of the reactor, and the voltage capacity of the second active part can be 70-30% of the whole voltage capacity of the reactor. Naturally, the two active parts can have the same size.

The coils in the two active parts can be coupled together in series or in parallel. That is, the coupling manner of the two coils can be serial or parallel.

The manner of coupling the coils in the two active parts together in series can be that one end of the coil in the first active part, i.e., the first coil, is a leading-in end, the other end of the first coil is connected to one end of the coil in the second active part, i.e., the second coil, and the other end of the second coil is a leading-out end, so that a serial connection is formed; the serial connection also can be that the first coil is connected to the second coil in series by using leading-in wires in the middle of the coils, i.e., the first coil employs a leading-in wire in the middle of the first coil and leading-out wires in both ends of the first coil, and the leading-out wires of the first coil are connected in parallel to be a leading-in wire of the second coil, the second coil employs the leading-in wire in the middle of the second coil and leading-out wires in both ends of the second coil, the leading-out wires in both ends of the second coil are connected in parallel, and the parallel connection between the leading-out wires in both ends of the first coil is coupled with the leading-in wire of the second coil in series.

When the two coils in the two active parts are connected in series, in the condition that the transporting height is satisfied, the number of the coil segments of the two coils is more than total number of the coil segments of the single-limb coil, and the total height of the coils is increased, thereby the creepage distance on the surface of the coils in the operation voltage is greatly increased. Thus, both of the coils bear the operation voltage, so as to guarantee the insulating reliability of the reactor in the operation voltage.

The manner of coupling the coils in the two active parts together in parallel can be that the ends of the coils are connected in parallel, i.e., one end of each of the two coils in the two active parts is a leading-in end thereof and is coupled together in parallel as a leading-in end, the other end of each of the two coils in the two active parts is a leading-out end thereof and is coupled together in parallel as a leading-out end; the parallel connection also can be that both of the coil in the first active part, i.e., the first coil, and the coil in the second active part, i.e., the second coil employ leading-in wires in the middle of the coils, and the middle leading-in ends of the two coils are connected in parallel, the upper end and the lower end of each coil are coupled together in parallel respectively and then the parallel connections of the two coils are connected in parallel as a leading-out end, that is, the first coil employs a leading-in wire in the middle of the coil, the upper end and the lower end of the first coil are leading-out ends and are connected in parallel, the second coil employs a leading-in wire in the middle of the coil, the upper end and the lower end of the second coil are leading-out ends and are connected in parallel, the leading-in ends in the middle of the first coil and the second coil are connected in parallel, and the two ends of the first coil and the two ends of the second coil are connected in parallel as a leading-out end.

In the condition that the requirements for transport and electric performance are satisfied, the parallel connection manner can be employed. When the middle leading-in manner is employed, the requirement of the insulating level of the ends of the coils is not high.

Certainly, the connection manner of the coils in the present invention is not limited to the above four manners.

Since the double active parts structure is employed in the present invention, the press tightness of the limb and the clamp tightness of the iron yokes of single iron core can be guaranteed. Thus, the noise and the vibration can be controlled. Meanwhile, the defect that the concentration of the loss of the reactor with a single active part whose capacity is the same as that of the present invention can be improved, and the temperature distribution of the whole reactor can be improved, thereby the defect that local hot spot exists in the active part is avoided.

Since the capacity of a single limb is decreased in the present invention, this double active parts structure is advanced in the control of the magnetic leakage and the heat radiation of the windings. Thus, this structure can be used in any reactor with different voltage levels and capacity requirements. For the reactor with 1000 kV and 100000 kvar, this structure can satisfy the requirements for the insulating reliability and the transport.

REFERENCE NUMERALS

1—high voltage bushing, 2—neutral point high voltage bushing, 3—reactor body, 4—oil storage, 6—oil tank, 7—iron core, 8—coil, 9—iron core cake, 10—iron core limb, 11—first coil, 12—second coil

DETAILED DESCRIPTION

The invention will be described in detail in the combination of the embodiments and the drawings.

The following embodiments are non-limited embodiments.

Figure 2:
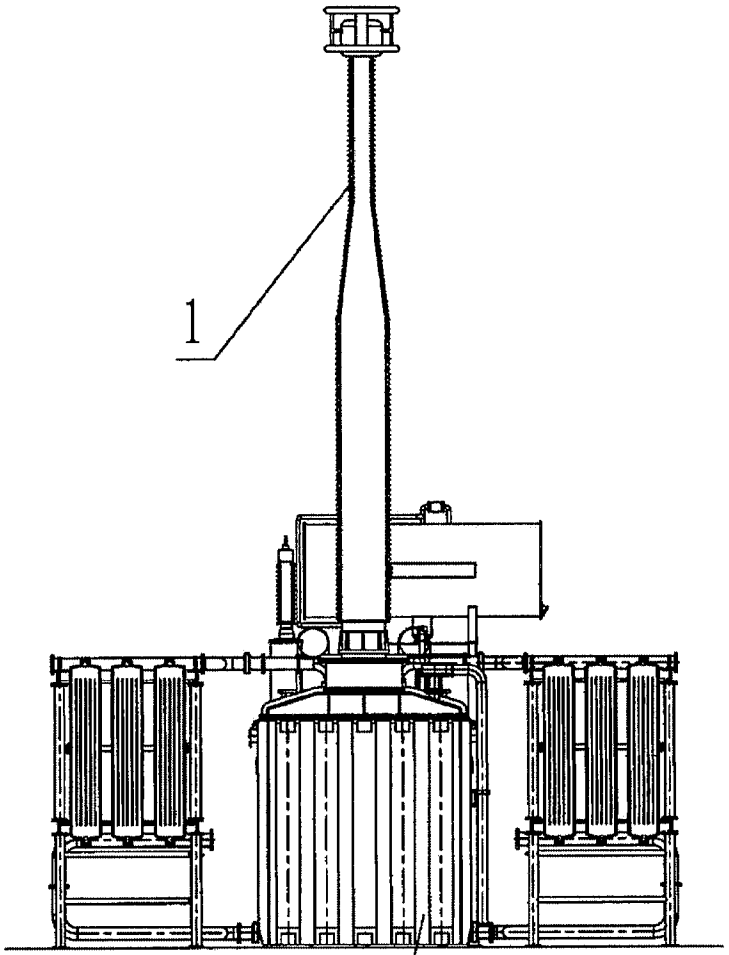
FIG. 2 is a side view of FIG. 1.
Figure 1:
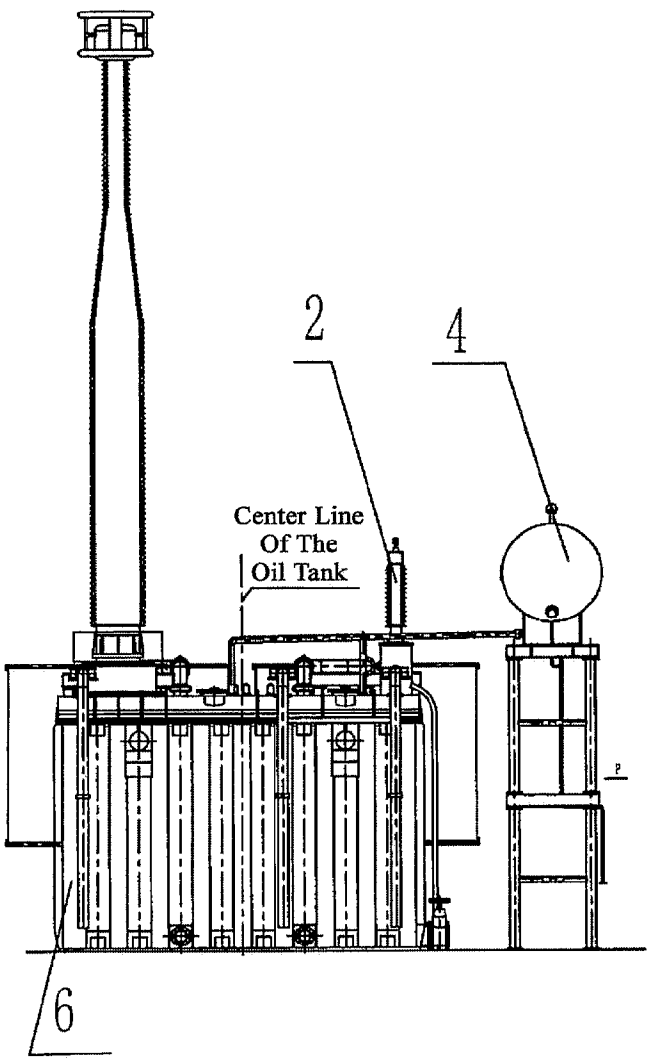
FIG. 1 is a plan view of the double active parts structure of the iron core reactor in the present invention.

As shown in FIGS. 1 and 2, the iron core reactor comprises a reactor body 3 and an oil storage 4. The reactor body 3 comprises two separate active parts. The two active parts constitute a double active parts structure, and are coupled together through the inner coils. Both of the active parts are placed in an oil tank 6, which is connected to the oil storage 4.

As shown in FIGS. 3-7, in the double active parts structure of the reactor in this invention, each active part comprises an "EI" shaped iron core 7 and a coil 8. In the middle of each "EI" shaped iron core, a plurality of iron core cakes 9 with central holes and a plurality of air gaps are laminated to form an iron core limb 10. The iron core limb 10 is tightened by a plurality of tensile rods which pass through the central holes. The upper and lower sides and the left and right sides of the iron core 7 are laminated by the iron core with a certain thickness, and are tightened by cross-core screw-rods. The iron core limb 10 is inserted into the coil 8.

Figure 3:
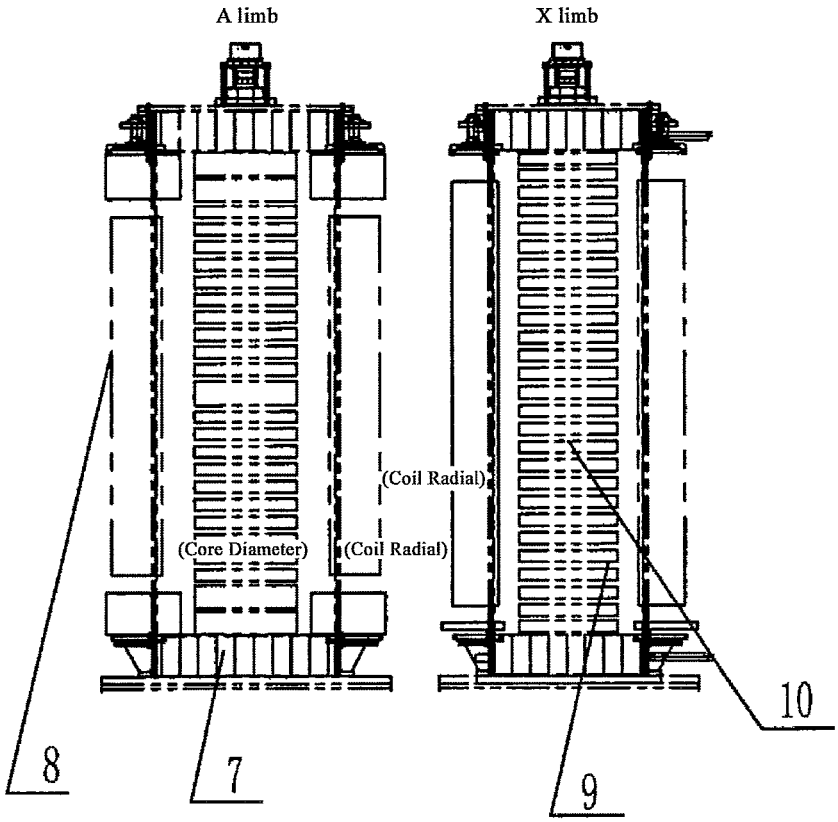
FIG. 3 is a plan view of the double active parts structure of the iron core reactor in the present invention (in the condition that the two active parts are arranged in parallel).
Figure 4:
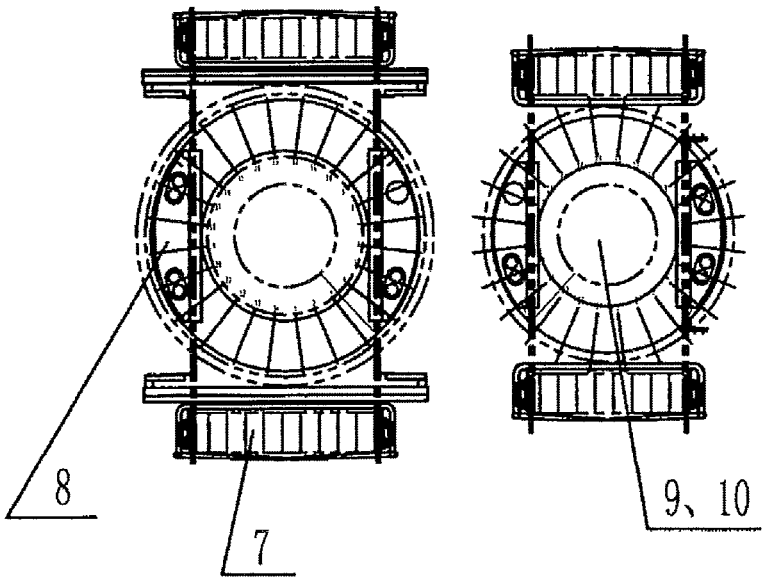
FIG. 4 is a top view of FIG. 3.
Figure 5:
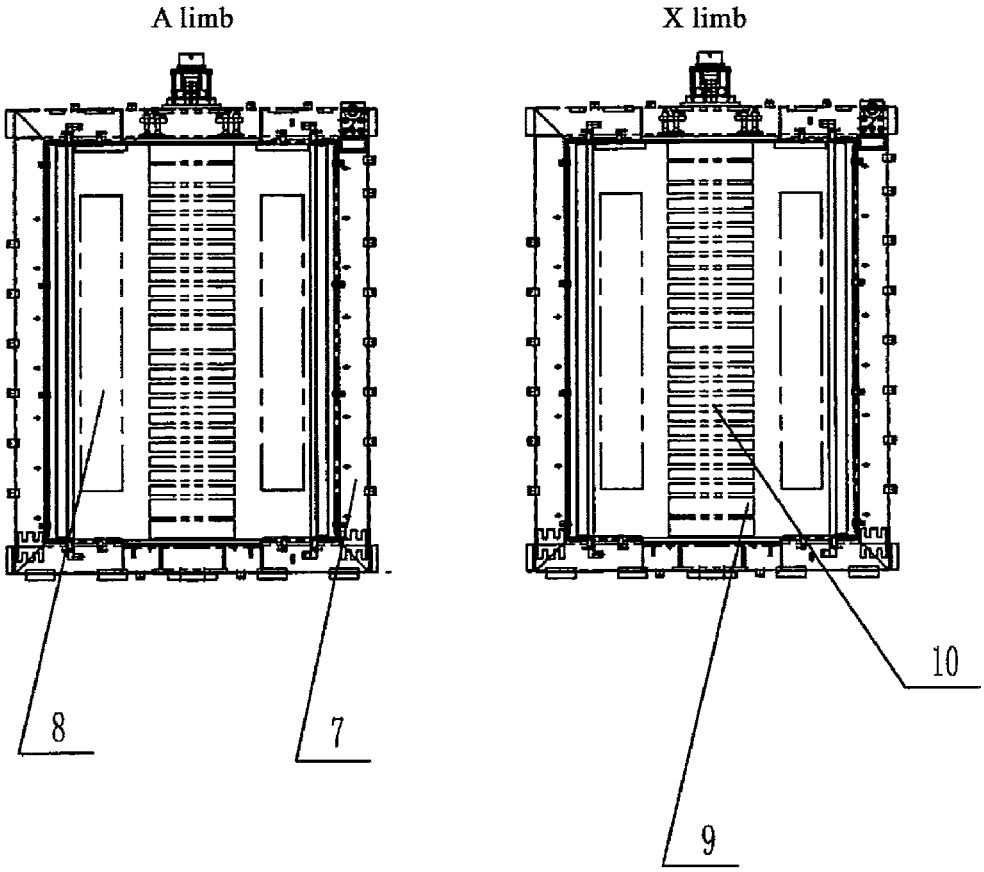
FIG. 5 is a plan view of the double active parts structure of the iron core reactor in the present invention (in the condition that the two active parts are arranged in in-line).
Figure 6:
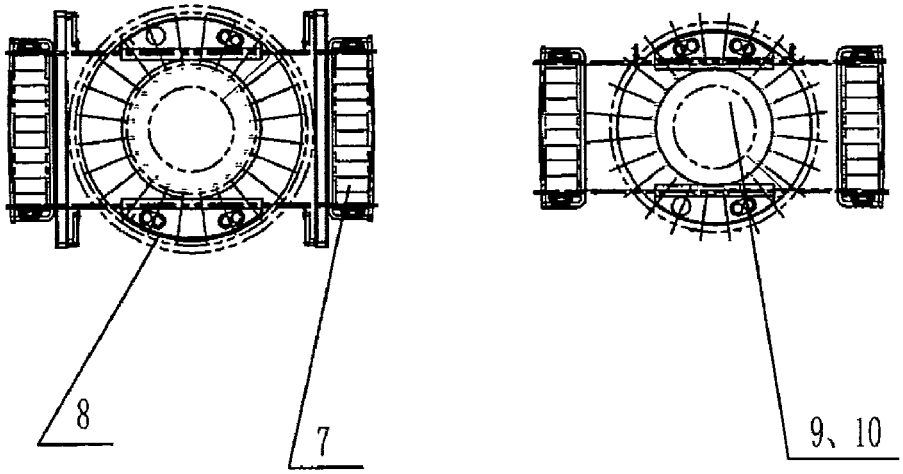
FIG. 6 is a top view of FIG. 5.
Figure 7:
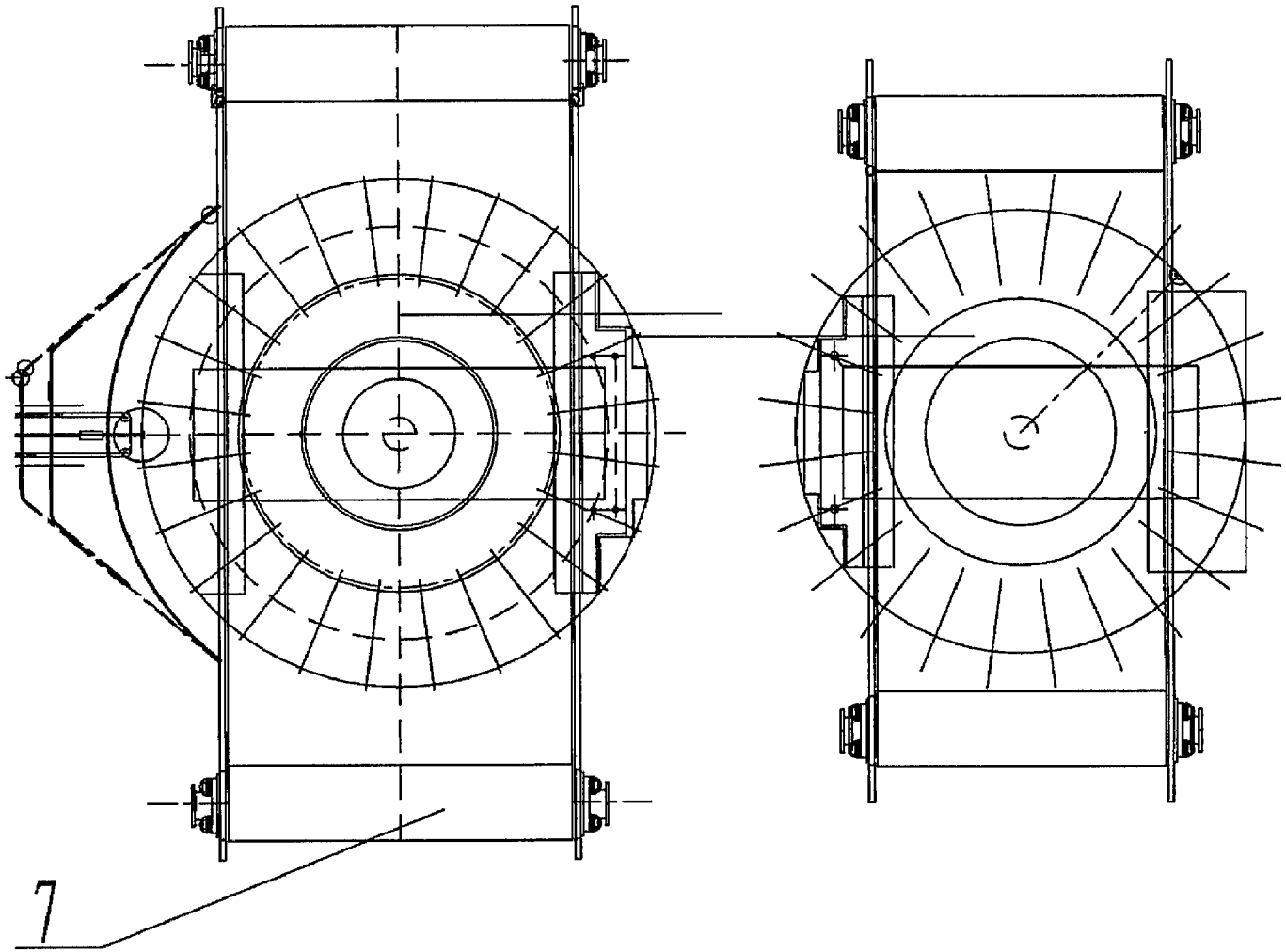
FIG. 7 is an enlarged view of FIG. 4.

The two active parts can be arranged in parallel (as shown in FIGS. 3 and 4) or in in-line (as shown in FIGS. 5 and 6).

The coils 8 of the two active parts are connected in series or in parallel.

Figure 8:
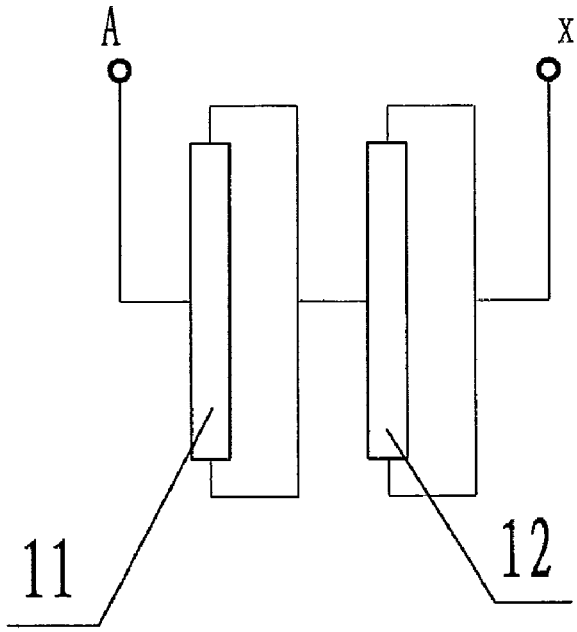
FIG. 8 is a view of the two coils with middle leading-in wires connected in series in the invention.

FIG. 8 shows the serial connection manner. The first coil 11 is connected to the second coil 12 in series by using leading-in wires in the middle of the coils, i.e., the first coil 11 employs a leading-in wire in the middle of the first coil 11 and leading-out wires in both ends of the first coil 11, and the leading-out wires of the first coil 11 are connected in parallel, the second coil 12 employs the leading-in wire in the middle of the second coil 12 and leading-out wires in both ends of the second coil 12, the leading-out wires in both ends of the second coil 12 are connected in parallel, and the parallel connection between the leading-out wires in both ends of the first coil 11 is connected to the leading-in wire of the second coil 12 in series.

Figure 9:
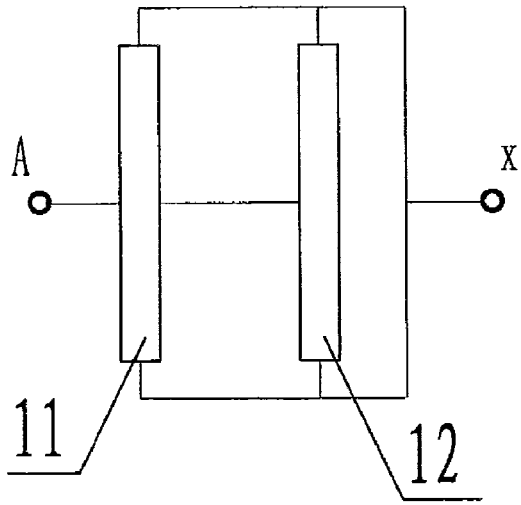
FIG. 9 is a view of the two coils with middle leading-in wires connected in parallel in the invention.

FIG. 9 shows the parallel connection manner. The first coil 11 and the second coil 12 are connected in parallel by employing leading-in wires in the middle of the coils. The parallel connection can be that both of the coil in the first active part, i.e., the first coil 11, and the coil in the second active part, i.e., the second coil 12 employ leading-in wires in the middle of the coils, and the middle leading-in ends of the two coils are connected in parallel, the upper end and the lower end of each coil are connected together in parallel respectively and then the parallel connections of the two coils are connected in parallel as a leading-out end, that is, the first coil 11 employs a leading-in wire in the middle of the coil, the upper end and the lower end of the first coil 11 are leading-out ends and are connected in parallel, the second coil 12 employs a leading-in wire in the middle of the coil, the upper end and the lower end of the second coil 12 are leading-out ends and are connected in parallel, the leading-in ends in the middle of the first coil 11 and the second coil 12 are connected in parallel, and the two ends of the first coil 11 and the two ends of the second coil 12 are connected in parallel as a leading-out end.

The above two coupling manners are suitable for the reactor with large capacity and high voltage, and can guarantee that the reactor has a good performance in heat radiation and the insulating performance is reliable.

The invention claimed is:

1. A double active parts structure of a reactor comprising a reactor active part, wherein:

the reactor active part comprises two separate active parts, which are coupled together through inner coils, the coils in the two active parts can be coupled together in series or in parallel; and the manner of coupling the coils in the two active parts together in series can be that one end of the coil in the first active part, i.e., the first coil, is a leading-in end, the other end of the first coil is connected to one end of the coil in the second active part, i.e., the second coil, and the other end of the second coil is a leading-out end, so that a serial connection is formed; the serial connection also can be that the first coil is connected to the second coil in series by using leading-in wires in the middle of the coils, i.e., the first coil employs a leading-in wire in the middle of the first coil and leading-out wires in both ends of the first coil, and the leading-out wires of the first coil are connected in parallel to be a leading-in wire of the second coil, the second coil employs the leading-in wire in the middle of the second coil and leading-out wires in both ends of the second coil, the leading-out wires in both ends of the second coil are connected in parallel, and the parallel connection between the leading-out wires in both ends of the first coil is connected to the leading-in wire of the second coil in series.

2. The double active parts structure of a reactor according to claim 1, wherein the arrangement mode of the two active parts is parallel or in-line.

3. The double active parts structure of a reactor according to claim 2, wherein the two active parts of the reactor are placed in a same reactor oil tank.

4. The double active parts structure of a reactor according to claim 3, wherein each of the two separate active parts comprises an "EI" shaped iron core, in the middle of which an iron core limb is formed by the lamination of a plurality of iron core cakes with central holes and a plurality of air gaps.

5. A double active parts structure of a reactor comprising a reactor active part, wherein the reactor active part comprises two separate active parts which are coupled together through inner coils;

the coils in the two active parts can be coupled together in series or in parallel; and the manner of coupling the coils in the two active parts together in parallel can be that one end of each of the two coils in the two active parts is a leading-in end thereof and is connected with each other in parallel as a leading-in end, the other end of each of the two coils in the two active parts is a leading-out end thereof and is connected with each other in parallel as a leading-out end; the parallel connection also can be that both of the coil in the first active part, i.e., the first coil, and the coil in the second active part, i.e., the second coil, employ leading-in wires in the middle of the coils, and the middle leading-in ends of the two coils are connected in parallel, the upper end and the lower end of each coil are connected together in parallel respectively and then the parallel connections of the two coils are connected in parallel as a leading-out end, that is, the first coil employs a leading-in wire in the middle of the coil, the upper end and the lower end of the first coil are leading-out ends and are connected in parallel, the second coil employs a leading-in wire in the middle of the coil, the upper end and the lower end of the second coil are leading-out ends and are connected in parallel, the leading-in ends in the middle of the first coil and the second coil are connected in parallel, and the two ends of the first coil and the two ends of the second coil are connected in parallel as a leading-out end.

6. The double active parts structure of a reactor according to claim 5, wherein the arrangement mode of the two active parts is parallel or in-line.

7. The double active parts structure of a reactor according to claim 6, wherein the two active parts of the reactor are placed in a same reactor oil tank.

8. The double active parts structure of a reactor according to claim 7, wherein each of the two separate active parts comprises an "EI" shaped iron core, in the middle of which an iron core limb is formed by the lamination of a plurality of iron core cakes with central holes and a plurality of air gaps.

* * * * *